United States Patent [19]

Kucharczyk

[11] 4,183,290

[45] Jan. 15, 1980

[54] AIR VENT

[75] Inventor: Eckhard Kucharczyk, Netphen, Fed. Rep. of Germany

[73] Assignee: Siegenia-Frank Kg., Siegen, Fed. Rep. of Germany

[21] Appl. No.: 897,154

[22] Filed: Apr. 17, 1978

[30] Foreign Application Priority Data

Jan. 31, 1978 [DE] Fed. Rep. of Germany ..... 2719144

[51] Int. Cl.[2] ..... E04B 1/99

[52] U.S. Cl. ..... 98/37; 181/30; 236/49

[58] Field of Search ..... 236/49, 1 R; 98/1 R, 98/40 D, 37; 181/30

[56] References Cited

U.S. PATENT DOCUMENTS 3,382,947 5/1968 Biggs ..... 181/30

FOREIGN PATENT DOCUMENTS 2331841 1/1975 Fed. Rep. of Germany ..... 181/36 D
7504175 6/1975 Fed. Rep. of Germany ..... 181/36 D
46-12005 of 1971 Japan ..... 236/1 R

*Primary Examiner*—William E. Wayner
*Attorney, Agent, or Firm*—Norman S. Blodgett; Gerry A. Blodgett

[57] ABSTRACT

Sound-absorbing air vent for rooms having openings that are selectively opened or closed by an electrical motor which is controlled by a sound-sensitive element.

12 Claims, 3 Drawing Figures

AIR VENT

BACKGROUND OF THE INVENTION

Sound-absorbing air vents are used in many places where strong sounds are to be absorbed, even if only part time, in the vicinity of buildings where strong sounds are present and have to be excluded from the inside of the building. Windows and doors have already been developed which are highly efficient with regard to sound absorption without interferring with the entering light to any great extent. However, since a constant air exchange must be present between the inside of the building and its surrounding space, it is necessary to open doors or windows at least part of the time. During that time, the high sound-absorbing effects are lost, or else the windows have to be designed in such a way that they may only be opened during cleaning procedures. In this case, the air exchange is brought about by special venting devices where, sound-absorbing linings have been provided in their air penetration openings or ducts. This is shown in German Pat. No. 23 31 841 and German petty Pat. No. 75 04 175.

Sound-absorbing windows, when closed, may absorb most of the sound peaks, as well as short-time ones. The same effect, however, may not be achieved in the open position of the sound-absorbing venting devices, because, in spite of the linings that have been installed, sound waves may still penetrate through the unempeded cross-section of the ducts through which the air penetrates.

These and other difficulties experienced with the prior art devices have been obviated in a novel manner by the present invention.

It is, therefore, an outstanding object of the invention to provide sound absorbing devices may be designed in such a way that they may be inserted into building walls as an individual unit.

Another object of this invention is the provision of sound absorbing devices formed as an integral part of windows and doors, so that they may be mounted together in the corresponding openings of the building walls.

A further object of the present invention is the provision of air vent capable of resisting effectively the penetration of sound waves into the inside space through the venting devices during sound peaks.

It is another object of the instant invention to provide sound absorbing venting device which prevent the penetration of sound waves into rooms originating from sound peaks.

With these and other objects in view, as will be apparent to those skilled in the art, the invention resides in combination of parts set forth in the specification and covered by the claims appended hereto.

SUMMARY OF THE INVENTION

In general, the present invention consists of an air vent in which a sound sensor, such as a microphone, is present. A time switch member is incorporated in a switching arrangement and is activated by the microphone. A drive is energized spontaneously by the air sound for first closing the openings or ducts and thereafter (with delayed action) opens ducts.

More specifically, repeated activation of the sound sensor causes the time delay period of the time switch member to be extended.

In order that the time switch member not be activated by every registered noise, this invention suggests that between the sound sensor and the time switch member is arranged a filter switch, such as a band pass filter, or a band rejection filter.

In a preferred design of this vent device constructed in accordance with this invention, the time switch member may flip over an exchange contact relay which, in its rest position, operates an open limit switch and places the drive into the electric circuit while air openings and ducts are open. In its switch position the relay connects an open limit switch for the opening operation when the air openings are closed.

Another design constructed in accordance with this invention provides that the time switch member may consist of a condenser and a resistor switched in series with the plus polarity; the plus polarity of the condenser and the inlet of the resistor is positioned on the emitter of a transistor with an emitter switch, and the outlet of the resistor is connected to the base of another transistor with an emitter switch and its collector current influences the exchange contact relay.

It is also advantageous that the condenser of the time switch member be switched parallel with a resistor against a diode, through a resistor and, on the other hand, through a constant variable resistor, a condenser, and another resistor to the plus polarity of the current source. The collector of the other transistor is connected between the resistor and the condensor and its emitter is connected directly to the minus polarity of the current source, while its base is connected, (on one hand) through a resistor to the plus polarity of the current source and (on the other hand) to the outlet of the condenser and with its inlet to the sound sensor.

Finally, it is important for a simple design of a venting device, according to this invention, that the drive be a synchronous motor driving a crank disk and that the carrying shaft have a control cam which displaces by 180° (and so closes or opens) the two limit switches, which are preferably micro switches.

With the crank disk it is easy to displace a sliding plate of the air vent for covering or closing the air openings. In one position of turning of the cam disk the plate is in its open position.

In order that the action current for operating the exchange contact relay in each case be strong enough, then, according to this invention, the collector of another transistor may be switched to the base of a third transistor, while its collector is connected with the minus polarity of the relay, and its emitter is connected to the minus polarity of the current source for the switching arrangement.

It is also suggested, according to this invention, that the base of the first transistor be placed on current against a resistor and two diodes (on one hand) to the minus polarity of the electrical source, and (on the other hand) is connected with the outlet of a condenser. Its inlet is connected to the sound sensor through two transistors which incorporate amplifiers. The inlet of the condenser is connected to the collector of the transistor, whose emitter is connected directly to the minus polarity of the current source and its base in the other turn position is in the closed position. A change of turn direction of the synchronous motor for opening and closing the air openings is prevented by this arrangement.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 3:
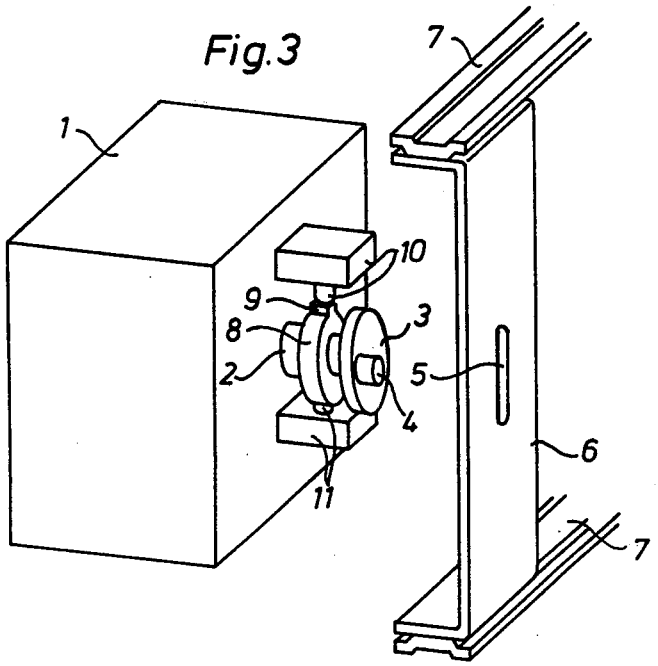
FIG. 3 is a perspective view of a design example for a driving device forming part of the invention.

FIG. 3 shows a preferred embodiment of this invention, including an electric motor drive for the movement of the closure device for the air vent openings. This drive consists of a synchronous motor 1 using alternating current and preferably designed as a gear motor for 220 Volt and 25 Watts.

On the drive shaft 2 of the gear motor 1 is mounted an eccentric disk 3 and its crank pin 4 engages a longitudinal slot 5 on a slide 6. The slide is connected to push rods 7 for moving a closure device (not shown).

A cam disk 8 with a control cam 9 is locked onto the shaft 2; the control cam 9 operates on two micro-switches 10 and 11 which are mounted on the housing of the drive motor 1.

The arrangement of the micro-switches 10 and 11 relative to each other and to the cam shaft 8 is selected so that the micro-switch 10 is open over the control cam only then when the crank disk 3 with its crank pin 4 is positioned in such a way that the closure device, determining the rotated position, is in its "open" position. However, the micro-switch 11 is opened by the control cam 9 of the cam disk 8 only when the crank disk 3 with its crank pin 4 is in the corresponding rotated position that determines the "closed" position of the closure device.

The two positions of rotation of the crank disk 3, which determine the "open" and "closed" position of the closure device, are displaced by 180° to each other, so that, after each turning of the drive shaft by 180°, one of the micro-switches 10 and 11 is opened and consequently interrupts the electrical current to shut off the drive motor 1.

Figure 1:
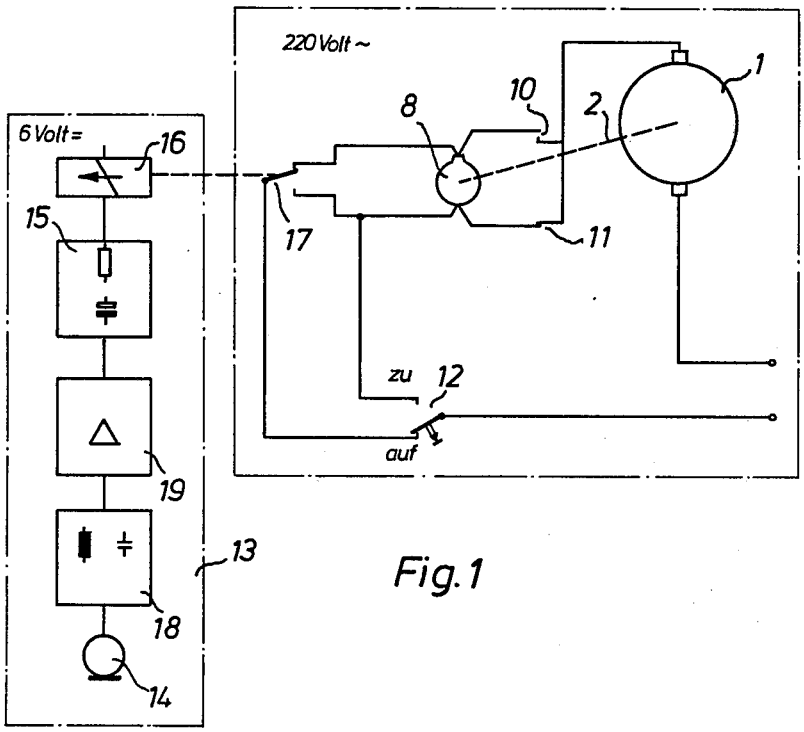
FIG. 1 is an electrical block diagram showing the control for the electrical drive for the closure mechanism of a sound-absorbing air vent constructed in accordance with the present invention.

In FIG. 1 of the drawing it can be seen that the drive motor 1 by the operation of the switch 12 may be cut into the electrical circuit through the micro-switch 10 or micro-switch 11. The micro-switch 10 is closed when the closure device of the sound-absorbing device is positioned in the "closed" position and is opened only when this closure device has reached its "open" position. The micro-switch 11, however, will be closed after the micro-switch 10 has opened; that is to say, it closes at the moment that the closing device has reached its "open" position and remains closed until the reversal of the switch 12 and the return to its "closed" postion of the closure device.

The operation of the switch 12 assures that the gear motor is always connected to the electrical circuit until the corresponding closed micro-switch 10 or 11 is opened by the control cam 9 of the cam disk 8. At this moment, the connection to the electrical circuit is opened and the holding relay 13 drops out.

According to FIG. 1, the gear motor 1 is provided with one more switch arrangement 13 for the operation of the closure device of the sound-absorbing air vent. The switch arrangement 13 is activated as soon as a stronger sound is picked up in the area of the sound-absorbing air vent. In that way, this switch arrangement forms an acoustical control by which the "open" closure device of the sound-absorbing air vent is suddenly moved into its "closed" position and remains there as long as the sound exists.

This switch arrangement 13 incorporates, as an important part, a sound sensing element 14, such as a microphone, a time switch member 15, and a relay 16, operated by the member 15, where the relay 16 flips over an exchange contact 17. In addition, this switch arrangement contains an additional filter switch 18 and an amplifier 19 between the sound sensing element 14 and time relay 15. The filter switch 18 passes only frequencies in a certain or predetermined frequency range; activate the time relay 15 through the amplifier 19.

As long as the time relay 15 is not activated, the relay 16 is in a state of rest and keeps the exchange contact 17 in position, as can be seen in FIG. 1. In this position of the exchange contact 17, the circuitry for the gear motor operation is regulated by the micro-switch 10; that is to say, only when the micro-switch 10 is closed may the gear motor 1 be out into the circuitry with the help of the switch arrangement. In that way, the micro-switch 10 is closed until the gear motor 1 has brought the closure device of the sound-absorbing air vent into its "open" position. At that moment, the switch is opened and the gear motor 1 comes to a stop.

If the time relay 15 is now activated, then the relay 16 is reversed and tilts the exchange contact 17 into its other position. The exchange contact 17 is kept in this other position until the time relay 15 is again deactivated. Thereafter, the contact 17 falls back into the rest position, after the relay 16 has dropped out. In the event that the exchange contact 17 of the micro-switch 11 is closed in its working position and the closure device of the sound-absorbing air vent is in its corresponding "open" position, then the gear motor 1 is connected into the circuitry and drives the closure device 7 to put it in its "closed" position. If this position is achieved, the micro-switch 11 then stops the gear motor 1. At the same time, the micro-switch 10 is closed. However, the closing of the micro-switch 10 has no effect, as long as the exchange contact 17 is still in its operating position. When the relay 16 is tipped back into its "rest" position (after de-energizing of the time relay 15), the gear motor 1, which is now connected in circuitry through the micro-switch 10, brings the closure device of the sound-absorbing air vent completely automatically back to its "open" position. As soon as this is achieved, the micro-switch 10 is opened and disconnects the gear motor 1 from the circuitry and the micro-switch 11 closes again.

In the event that a new sound occurs, the described cycle of operation is repeated, that is to say, the closure device of the sound-absorbing air vent is immediately closed and, thereafter, after a certain time, as determined by the time relay 15, opened again.

The switch arrangement 13, while activating the acoustical control of the closure device for the sound-absorbing air vent, does not prevent the control of the switch 12 by hand, that is to say, by manually operating the switch 12, the air vent may be opened or closed at any time. However, in the event that sound event occurs at practically the same time a hand operated opening, then a new closure procedure starts immediately, so that an opening procedure follows which is timely controlled.

Figure 2:
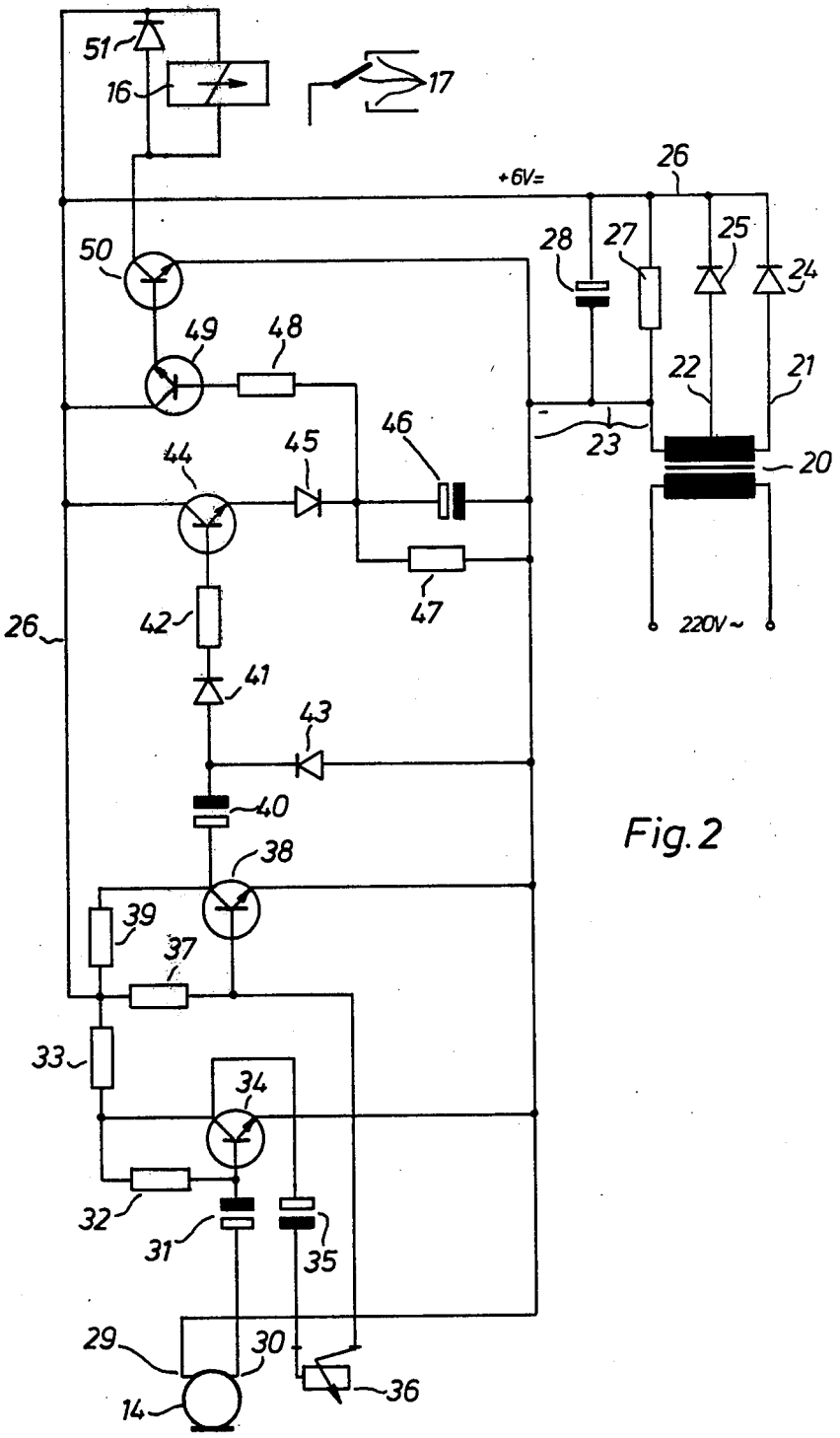
FIG. 2 is an electrical diagram of the control arrangement showing its important elements.

A possible design of the switch arrangement for the acoustical control of the closing and opening operation for the closure device for a sound-absorbing air vent can be seen in FIG. 2.

This switch arrangement is operated by 6-Volt direct current, which may be transformed from an alternating current of 220 Volts by means of a transformer 20. As already mentioned, the gear motor 1 works from an alternating current circuit.

On the secondary side of the transformer 20 are located two plus-lines 21 and 22 and the minus-line 23 which are switched in cascade fashion. Into each of the plus lines 21 and 22 is inserted a diode 24 or 25 of the N4007 type. Behind these diodes 24 and 25, the two plus-lines are switched to a common line 26 which delivers the 6-Volt direct current electricity.

Furthermore, it can be seen in FIG. 2 that between the plus-line 26 and minus-line 23 of the transformer 20 is connected a resistance 27 of approximately 680 ohm and a condenser 28, having a capacity of 470 microfarad, for example, are connected in parallel.

The minus contact 29 of the sound sensor 14 is connected directly to the minus outlet line 23 of the transformer, but following the resistor 27 and the condensor 28.

The plus contact 30 of the sound sensor 14 is placed at the entrance of a condenser 31 having a capacity of 3.3 microfarad, for example. The outlet of the condenser 31 is attached to the plus line 26 through a resistor 32 of 1 megohm and another resistor 33 of 56 kilohm. On the other hand, the outlet of the condenser 31 is also connected to the base of a transistor 34 which has the designation BF 194. The collector of the transistor 34 is attached to the plus-line 26 between the two resistors 32 and 33 and is also connected to the entrance of a condenser 35, having a capacity of 3.3 microfarad. The outlet of the condenser 35 is connected to one side of an adjustable resistor 36 of 47 kilohm whose other side is connected to the plus-line 26 through a reistor 37 of 560 kilohm.

The emitter of the transistor 34 is directly connected to the minus-line 23 of the transformer, having the designation BF 194. Between the constant adjustable resistor 36 and the resistor 37 is attached the base of a transistor 38, which transistor has the designation BC 238. Its collector is connected (on one hand) with the plus-line 26 through a resistor 39 of 1 kilohm and (on the other hand) switched to the inlet of the condenser 40 which has a capacity of 3.3 microfarad, for example. The emitter of the transistor 38 is directly connected to the minus outlet line 23.

The outlet side of the condenser 40 is switched through a diode 41 to a resistor 42, for example, of 1 megohm. A position between the exit of the condenser 40 and the inlet of the diode 41 is connected to minus outlet line 23 through a diode 43.

The resistor 42 is connected to the base of a transistor 44 of the BC 238 type, whose collector is directly connected to the plus-line 26. Its emitter is positioned at the inlet of a diode 45. The outlet of the diode 45 is (on the one hand) connected to the inlet of a condensor 46 whose outlet is directly connected to the minus outlet line 23. The condensor 46, for example, has a capacity of 100 microfarad. Parallel to the condensor 46 is connected a resistor 47 of 1 megohm between the outlet of the diode 45 and the minus outlet line 23.

The outlet of the diode 45 is connected to the inlet of the condenser 46 and also to one side of a resistor 47 and to a resistor 48 of 1 megohm which operates on the base of a transistor 49 which has the designation BC 238. The collector of this transistor 49 is attached to the plus line 26, and its emitter is connected to the base of a transistor 50.

This transistor 50 has preferably the designation 2 N 3877 and its collector is attached to the minus contact of the relay 16 whose plus contact is connected to the line 26. Between the plus and minus contact of the relay 16 is interpositioned a diode 51, which may carry the designation 1 N 4007 which prevents damage to the transistor 50.

In the previously-described switch arrangement, the transistors 34, 38, 44, and 49 are provided in the emitter (basis) diagram; however, the transistor 50 is provided with emitters. All transistors 34, 38, 44, 49, and 50 act together as the amplifier 19 of the work current of the relay 16. The constant adjustable resistor 36, but the interpositioning of the condenser 35 between the emitter of the transistor 34 and the base of the transistor 38, form the simple filter switch 18 with its adjustable frequency limits and serves to adjust the corresponding frequency changes to which the acoustic control has to react in case of sound increases. In its place, however, can be provided suitable band-pass filters or band rejection filters. The condensor 46 forms with the resistor 48 the actual time switch member 15 in which the corresponding time constant is determined by the resistor 47 connected parallel to the condenser 46. If the time constant of the time switch members 15 is variable, the resistor 47 can also be designed as a constant variable resistor.

In case of a sound increase, the time switch member 15 is activated by the loading of the condensor 46, whenever the sound frequency is of such a magnitude that it filters through the filter switch 18. The loading of the condensor 46 is activated through the transistor 44 and the diode 45 and at the same time is made penetrable through the resistor 48 and the transistor 49, so that it may permit current flow over the outlet circuit to the base of the transistor 50. The current flow through the outlet circuit of the transistor 49 remains on for such a timer period as the condensor 46 takes to discharge through the resistor 48. During this time period, the transistor 50 remains open for the current flow. The relay 16 tilts out of its rest position into the switch position and remains there until the current flow through the transistor 50 is interrupted. For the corresponding time period, the exchange contact 17 is also brought into operating position out of the rest position. During the operating position of the exchange contact 17, if the closure device of the sound-absorbing air vent is in its "open" position, then the circuit current passes through the micro-switch 11 to the gear motor 1, so that it may return the closure device to its "closed" position. The micro-switch 11 opens up and the micro-switch 10 closes. In case the relay 16 falls back into the rest position and with it the exchange contact 17, after a certain time determined by the time switch member 15, the gear motor 1 is energized through the micro-switch 10, so that the closure device may be put in "open" position again. The micro-switch 10 now opens up and the micro-switch 11 closes; the entire arrangement is now free again for another operating cycle.

It should be pointed out that several sounds introduced in short sequence, activate the time switch relay, as long as they contain sound frequencies that filter through the filter switch 18, and extend correspondingly the predetermined time period by the corresponding time interval between the sequential sound events. The switch arrangement as shown in FIG. 2 should be considered only as a possible design for acoustical control of the closure device of a sound-absorbing air vent and is equipped only with NPN transistors. Also, another switch design diagram is possible.

The previously described acoustical control is mainly for the use in connection with sound-absorbing air vents for rooms, which may be mounted as individual units into wall openings of buildings, or may be a design unitary with windows and doors. These sound-absorbing air vents may be so-called "continuous" venting devices, whose operation is based upon the small pressure differential between the inside room space and its surroundings. It is also useful for forced ventilation, which creates air exchange by fan means. In the last case, in addition to the movement of the closure device, the drive of the fan may also be influenced by the acoustical control.

Finally, the acoustic control may also be used for the operation of wings to be opened on sound-proof windows and doors, for example, for the adjustment of a forced-movement scissor apparatus.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Air vent for rooms where its air vent openings respectively ducts can selectively be opened or closed by electrical drives, characterized by the fact that a sound sensor (14) such as a microphone and a time-switch relay (15) activated by the microphone contained within a switch arrangement which, on open vent openings, puts the drive (1), not presently under current, during sound increase, immediately into the electrical circuit, first for the closure of the openings and thereafter with delayed action for the opening of the vent openings.

2. Air vent according to claim 1, characterized by the fact that through repeatedly activating the sound sensor (14), the delay period of the time switch member (15) is extended.

3. Air vent according to claim 2, characterized by the fact that between the sound sensor (14) and the time switch member (15) a filter switch (18) is provided in the form of a band pass filter or a band rejection filter.

4. Air vent according to claim 3, characterized by the fact that the time switch member (15) tilts over a relay (16) with exchange contact (17) which, in its rest position puts on opened micro-switch (10) for the drive (1) under current, exclusively with opened vent openings, but in its switch position puts an opened micro-switch (11) for the drive (1) under current only with closed air openings.

5. Air vent according to claim 4, characterized by the fact that the time switch member (15) consists of a condenser (46) and resistor (48) switched into series at the inlet of the condenser (46) and the one side of the resistor (46) is positioned against one diode (45) on the emitter of a transistor (44) with emitter control, and the other side of the resistor (48) is connected to the base of another transistor (49) with emitter control and its collector current influences the exchange contact relays (16, 17).

6. Air vent according to claim 5, characterized by the fact that the condensor (46) of the time switch member (15) is connected in parallel to the diode (45) with a resistor (47).

7. Air vent according to claim 6, characterized by the fact that the collector of the other transistor (49) is connected to the base of a transistor (50) and its collector is connected to the negative contact of the relay (16) and its emitter with the negative pole (23) of a current source (20).

8. Air vent according to claim 7, characterized by the fact that the base of transistor (44) is connected to a resistor (42) andd two diodes (41 and 43) are connected (on one hand) to the negative polarity (23) of the current source (20) and (on the other hand) with the outlet of a condenser (40) whose inlet is connected the current source (20) over an ohm resistor (39) with the plus polarity (26).

9. Air vent according to claim 8, characterized by the fact that the inlet of the condenser (40) is connected with the sound sensor (14) furthermore over an amplifier containing two transistors (38 and 34).

10. Air vent according to claim 9, characterized by the fact that the inlet of the condenser (40) is connected to the emitter of the transistor (38) and its collector is connected directly to the negative outlet (23) of the current source (20) while its base is connected on one hand to a resistor (37) and on the other hand to an adjustable resistor (36), a condenser (35), and another resistor (33) positioned at the positive outlet (26) of the current source (20) and the collector of the transistor (34) is connected between the resistor (33) and the condenser (35) and its emitter is in immediate contact with the negative outlet (23) of the current source (20) and the base on one hand is in connection with the positive outlet (26) of the current source (20) through a resistor (32) and on the other hand is connected to the outlet of a condenser (31) where its inlet is connected to the positive contact of the sound sensor (14).

11. Air vent according to claim 10, characterized by the fact that the current source (20) has two plus-contact connections (21 and 22) and into each is switched-in one diode (24 or 25) and that the outlet of both diodes (24 and 25) are lead together again to (26) and that beyond the connection (26) between the plus outlet (26) and the minus outlet (23) of the current source, an ohm resistor (27) and a collector (28) is switched-in parallel.

12. Air vent according to claim 11, characterized by the fact that the drive is an alternate current asynchronmotor (1) driving a crank disk (3, 4) and the shaft (2) carrying the crank disk (3, 4) has a control cam (8, 9) which closes and opens the two micro-switches (10, 11) interchangable by a turn angle of 180°.

* * * * *